US005651503A

United States Patent [19]

Ricco

[11] Patent Number: 5,651,503

[45] Date of Patent: Jul. 29, 1997

[54] DEVICE FOR ADJUSTING THE TRAVEL OF A FUEL INJECTOR SHUTTER

[75] Inventor: Mario Ricco, Bari, Italy

[73] Assignee: Elasis Sistema Ricerca Fiat Nel Mezzogiorno Societa Consortile per Azioni, Pomigliano D'Arco, Italy

[21] Appl. No.: 496,422

[22] Filed: Jun. 29, 1995

[30] Foreign Application Priority Data

Jul. 1, 1994 [IT] Italy ..... T0940142 U

[51] Int. Cl.[6] ..... F02M 45/02

[52] U.S. Cl. ..... 239/533.4; 239/533.9

[58] Field of Search ..... 239/533.2, 533.3, 239/533.4, 533.5, 533.9, 533.11, 585.1, 585.2; 251/43, 86, 320, 321

[56] References Cited

U.S. PATENT DOCUMENTS

| | | | |
|---|---|---|---|
| 4,660,770 | 4/1987 | Greseking | 239/533.9 |
| 4,934,599 | 6/1990 | Hasagawa | 239/533.9 |
| 5,165,607 | 11/1992 | Stevens | 239/533.9 |
| 5,244,152 | 9/1993 | Hofmann | 239/533.9 |
| 5,413,281 | 5/1995 | Hofmann et al. | 239/533.9 |
| 5,464,156 | 11/1995 | Ricco et al. | 239/124 |
| 5,487,508 | 1/1996 | Zuo | 239/533.9 |

*Primary Examiner*—Andres Kashnikow
*Assistant Examiner*—Lisa Ann Douglas
*Attorney, Agent, or Firm*—Ladas & Parry

[57] ABSTRACT

A shutter in the form of a needle is controlled by a rod in turn controlled by an electromagnetic metering valve and which acts on the needle via a cylindrical plate formed in classes differing in terms of height. The plate for fitment between the rod and the needle is selected from the class corresponding to the travel of the needle required to open one or more orifices in the nozzle; and, to absorb any transverse components of the forces exchanged between the rod and needle and so prevent wear of the contacting surfaces of the needle and nozzle, the plate is guided inside the injector body with a very small clearance, e.g. in the region of 0.02 mm.

12 Claims, 1 Drawing Sheet

DEVICE FOR ADJUSTING THE TRAVEL OF A FUEL INJECTOR SHUTTER

BACKGROUND OF TEE INVENTION

The present invention relates to a device for adjusting the travel of a fuel injector shutter.

The travel setting of the shutter on a fuel injector nozzle is extremely important in that it determines the maximum delivery and consequently also the opening and closing time of the injector; and, on known injectors, it is adjusted by means of washers on the end of the shutter or needle control rod on which the pressurized fuel acts.

The washers are therefore subject to wear, due to the severe dynamic stress to which they are subjected, and, what is more, in no way contribute towards reducing or eliminating any transverse forces transmitted by the rod to the needle, thus resulting in wear of the mating surfaces between the needle and nozzle.

SUMMARY OF THE INVENTION

It is an object of the present invention to provide an extremely straightforward, reliable device for adjusting the travel of a fuel injector shutter, and designed to overcome the aforementioned drawbacks typically associated with known devices.

According to the present invention, there is provided a device for adjusting the travel of a fuel injector shutter, wherein the shutter is in the form of a needle for closing the nozzle, and is controlled by a coaxial rod in turn controlled by an electromagnetic metering valve; the rod acting on said needle via a substantially cylindrical plate; and the guide of said plate being defined by a seat coaxial with said rod; characterized in that said guide presents a very small clearance, so that said plate absorbs any transverse components of the forces exchanged between and due to misalignment of said rod and said needle.

According to a further characteristic of the present invention, said plate is formed in different classes in terms of height, a plate in one of said classes being selected for fitment between said rod and said needle so as to adjust the travel of the needle to conform with the required opening of the nozzle.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
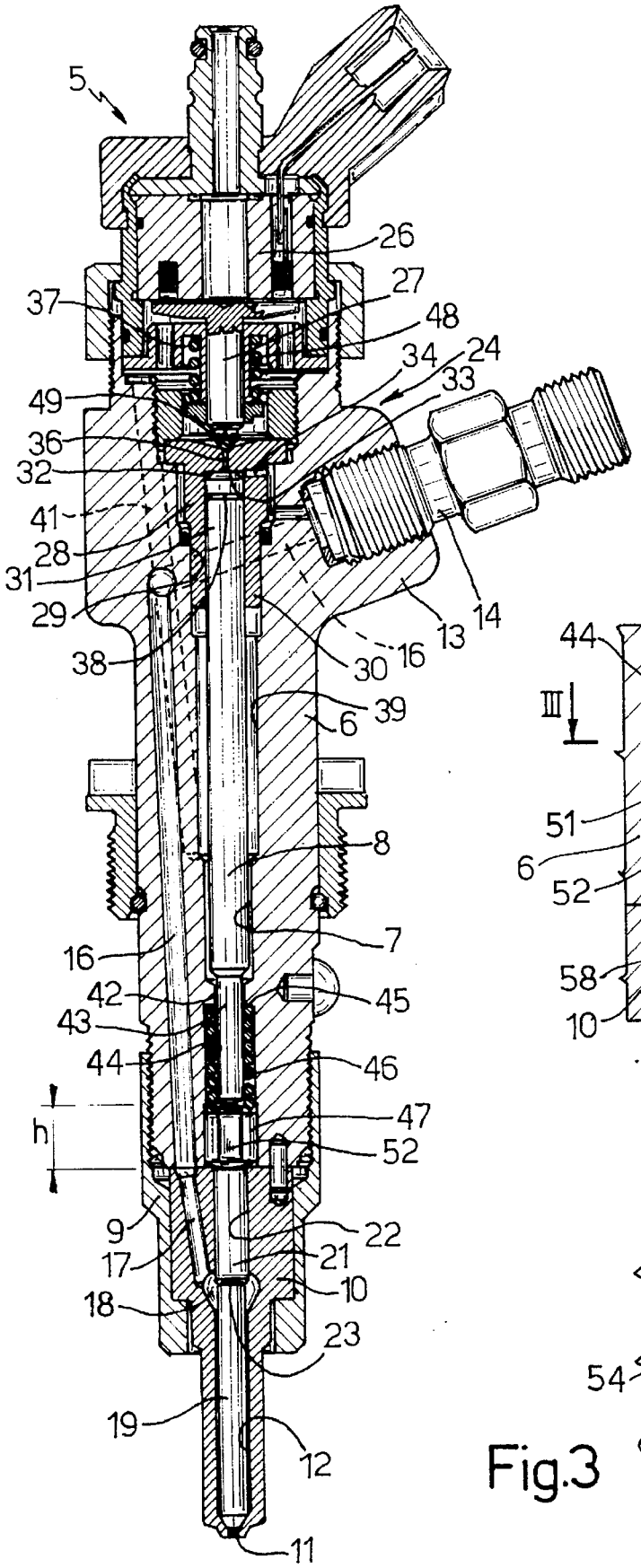
FIG. 1 shows a half section of a fuel injector featuring a shutter travel adjusting device in accordance with the present invention.

Number 5 in FIG. 1 indicates a fuel injector, e.g. for a diesel internal combustion engine, comprising a hollow body 6 with an axial cavity 7 in which slides a control rod 8. At the bottom, body 6 is fitted by means of a ring nut 9 with a nozzle 10 terminating with one or more injection orifices 11 communicating with an axial cavity 12 of nozzle 10.

Body 6 presents an appendix 13 connected to a high-pressure, e.g. 120 MPa, fuel supply fitting 14 communicating, via a conduit 16 in body 6 and a conduit 17 in nozzle 10, with an injection chamber 18 in turn communicating with cavity 12. Orifice 11 is normally closed by a needle type shutter 19 housed coaxially with rod 8 inside cavity 12 and presenting a larger-diameter portion 21 which is guided in sliding manner inside a seat 22 formed in nozzle 10 and coaxial with cavity 12, and forms a shoulder 23 on which the pressurized fuel in chamber 18 acts.

Injector 5 also comprises a metering valve 24 controlled by an electromagnet 26 controlling an armature 27; metering valve 24 comprises a head 28 housed inside a seat 29 formed in body 6 and coaxial with cavity 7; and head 28 presents a sleeve 30 for precision-fit guiding the top portion 31 of rod 8.

Sleeve 30 forms a control chamber 32 defined by the upper surface 33 of portion 31 of rod 8, which presents a larger surface than shoulder 23 of needle 19; and control chamber 32 communicates, via an inlet conduit 34, with the high-pressure fuel from fitting 14, and, via a drainage conduit 36, with a drainage chamber 37 in turn communicating with the fuel tank.

Portion 31 of rod 8 presents an annular groove 38 for more evenly distributing the fuel pressure from high-pressure control chamber 32 to a low-pressure chamber 39 which communicates with drainage chamber 37 via a conduit 41 formed in body 6, so that said low pressure is atmospheric.

Groove 38 provides for eliminating or reducing the transverse components of the forces generated by said pressure reduction via precision fit 30–31, thus eliminating the wear caused by the surface of portion 31 sliding along a generating line of the inner surface of sleeve 30.

At the bottom, chamber 39 presents a smaller-diameter portion 42 engaged by a smaller-diameter portion 43 of rod 8; and, at the bottom, portion 42 forms a shoulder 45 defining a chamber 44 in which is housed a compression spring 46 resting, at the top, on shoulder 45 and, at the bottom, on a plate 47 located between portion 43 of rod 8 and top portion 21 of needle 19.

Electromagnet 26 is normally de-energized so that, by means of a further spring 48, armature 27 acts on a ball shutter 49 to close drainage conduit 36 of control chamber 32. The fuel pressure inside control chamber 32 therefore acts on surface 33 of top portion 31 of rod 8, and, together with the action of spring 48, is greater than the fuel pressure on shoulder 23 of needle 19, so that rod 8 is held down together with plate 47 and needle 19 which thus closes orifice 11 of nozzle 10.

When electromagnet 26 is energized, armature 27 is raised so that the fuel pressure in chamber 32 opens metering valve 24; the fuel is drained from chamber 32 along conduit 36 into chamber 37 and back to the tank; and the fuel pressure in injection chamber 18, which is now greater than the remaining pressure on surface 33 of rod 8 and the force exerted by spring 37, raises needle 19 to open orifice 11 and so inject the fuel contained inside chamber 18 and conduits 16, 17.

When electromagnet 26 is again de-energized, armature 27 is lowered rapidly by spring 48 to close control chamber 32, so that, by means of rod 8 and spring 46, the pressurized fuel again lowers needle 19 to close orifice 11.

According to the present invention, to adjust the travel of needle 19, plate 47 is formed in different modular classes in terms of height h. Provision may conveniently be made for plates 47 of five classes differing in height h by 0.02 mm; and the class of plate 47 to be fitted in each case between rod 8 and needle 19 is so selected that height h corresponds to the required travel of needle 19, e.g. in terms of maximum delivery of the injector.

Figure 2:
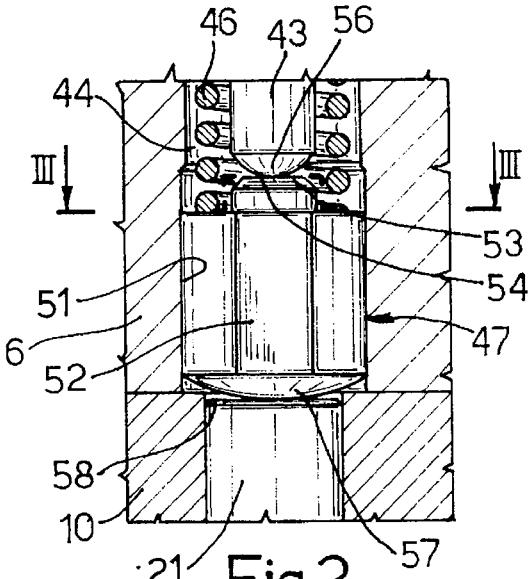
FIG. 2 shows a larger-scale section of a detail in FIG. 1.

Plate 47 also provides for absorbing any transverse components of the forces exchanged between and inevitably due to slight misalignment of rod 8 and needle 19, for which purpose, plate 47 slides inside a guide formed by a seat 51 (FIG. 2) defined by the bottom portion of chamber 44, and the surface of which is machined so as to mate accurately, i.e. with a very small clearance of, say, 0.02 mm, with the cylindrical surface of plate 47.

As plate 47 is housed inside the low-pressure portion of chamber 44, and on account of the pressures in chambers 32 and 18, rod 8, plate 47 and needle 19 are never detached and move integrally with one another as though in one piece, thus eliminating any dynamic stress on adjusting element 47 and hence wear on the contacting parts.

As is known, injector 5 operates at a pressure of over 120 MPa in chambers 18 and 32 (FIG. 1); and, as surfaces 23 and 33 subjected to this pressure are in the region of 12–16 $mm^2$, the forces involved are roughly 2000 N, any transverse components of which may therefore impair smooth sliding of rod 8 inside cavity 7, of top portion 31 of rod 8 inside sleeve 30, and of portion 21 of needle 19 inside seat 22, which present a very close tolerance fit, e.g. with a radial clearance of about 0.001 mm.

Figure 3:
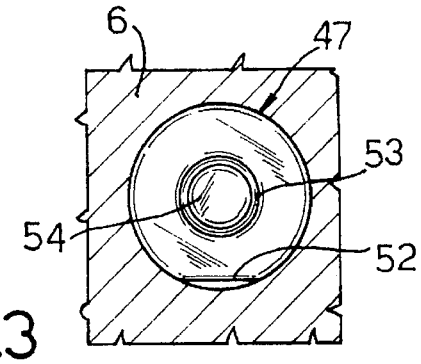
FIG. 3 shows a section along line III—III in FIG. 2.

According to a further characteristic of the present invention, the cylindrical surface of plate 47 presents a flat portion 52 (FIGS. 2 and 3) defining a passage into low-pressure chamber 44 for the fuel seeping from high-pressure chamber 18 and between the mating surfaces of seat 22 and portion 21 of needle 19.

Moreover, plate 47 contacts rod 8 and/or needle 19 by means of at least one pair of mating surfaces comprising a convex surface and a flat surface.

More specifically, at the top, plate 47 presents a small truncated-cone-shaped portion 53 terminating at the top with a flat surface 54 engaging a convex surface 56 at the bottom end of portion 43 of rod 8; which portion 53 also provides for effectively centering and guiding and so preventing slippage of spring 46 inside chamber 44. At the bottom, plate 47 presents a slightly convex surface 57 engaging a flat surface 58 of portion 21 of needle 19; and the forces between mating surfaces 54,56 and 57,58 are so transmitted that the transverse components of the forces exchanged between and due to any misalignment of rod 8 and needle 19 are absorbed by plate 47.

The advantages of the adjusting device according to the present invention will be clear from the foregoing description. In particular, it provides for adjusting the travel of needle 19 in a region not subjected to dynamic stress, and for absorbing any transverse components of the forces exchanged between rod 8 and needle 19.

Clearly, changes may be made to the adjusting device as described and illustrated herein without, however, departing from the scope of the present invention. In particular, plate 47 may present two flat surfaces engaging convex mating surfaces of rod 8 and needle 19, and vice versa; mating surfaces 54,56 and 57,58 in one or both pairs may be both convex, or one convex and the other concave; plate 47 may present a different number of, e.g. two diametrically-opposed, flat portions 52; and flat portions 52 may be replaced by axial or helical grooves.

I claim:

1. In a system for a fuel injector, the improvement of a device for adjusting a shutter, comprising:

a needle (19) for travel to open and close a nozzle (10, 11); and a rod (18) for acting coaxially on said needle to control said travel of said needle, wherein said rod (8) acts on said needle (19) via a substantially cylindrical plate (47) guided by a seat (51) coaxial with said rod (8), said seat (51) presenting a very small clearance with respect to said plate (47) so that said plate (47) absorbs any transverse components of forces exchanged between said rod (8) and said needle (19), and (a) said plate (47) and said rod (8) and (b) said plate (47) and said needle (19) being mutually engaged by pairs of mating surfaces (54, 56; 57, 58) respectively thereof, one of said mating surfaces (54, 58) of each of said pairs being flat, and the other of said mating surface (56, 57) of each of said pairs being convex.

2. A device as claimed in claim 1, wherein said clearance is in the region of 0.02 mm.

3. A device as claimed in claim 1, and further comprising:

plates (47) of respectively different heights (h), wherein one of said plates (47) is selected for fitment between said rod (8) and said needle (19) so as to adjust said travel of said needle (19) to conform with a required opening of said nozzle (10, 11).

4. A device as claimed in claim 1, wherein said plate (47) presents a convex surface (57) engaging a flat surface (58) of said needle (19).

5. A device as claimed in claim 1, wherein said plate (47) presents a truncated-cone-shaped portion (53) terminating with a flat surface (54) engaging a convex surface (56) of said rod (8).

6. A device as claimed in claim 5, wherein said plate (47) is located between a high-pressure injection chamber (18) and a low-pressure chamber (44), and wherein said truncated-cone-shaped portion (53) provides for guiding and centering a spring (46) inside said low-pressure chamber (44), and so preventing said spring (46) from slipping against walls of said low-pressure chamber (44).

7. A device as claimed in claim 5, wherein said seat (51) presents a very small radial clearance with respect to said plate (47), so that said plate (47) absorbs any transverse components of forces exchanged between and due to misalignment of said rod (8) and said needle (19).

8. In a system for a fuel injector comprising an injector body (6), a nozzle (10, 11) secured to said injector body (6), a needle (19) for axially sliding in said nozzle for opening and closing said nozzle (10, 11), a rod (8) in said body (6) and coaxial with said needle (19) for sliding in said body (6), and a metering valve (24) for controlling said sliding of said rod (8), said metering valve (24) comprising a control chamber (32) communicating with a high-pressure fuel supply fitting (14), a drain conduit (36) normally closed by an armature (27) of an electromagnet (26), and a device for adjusting said sliding of said needle (19) and, thereby, said opening of said nozzle, the improvement of said system wherein said device comprises:

a modular class of substantially cylindrical plates (47) differing from each other by a constant value of height (h) for selection of one of said plates (47) for fitment between said needle (19) and said rod (8), said one of said plates (47) being axially guided by a cylindrical seat (51) coaxial with said rod (8), whereby to adjust said sliding of said needle (19) to conform with a required opening of said nozzle (10, 11).

9. A system as claimed in claim 1, wherein a lateral surface of said one of said plates (47) presents means (52)

for enabling passage of fuel from said fitting (14) into a high-pressure injection chamber (18) of said nozzle (10, 11) and low-pressure chamber (44) of said injector body (6).

10. A system as claimed in claim 9, wherein said rod (8) has a portion (31) guided inside a seat of a sleeve (30) adjacent to said control chamber (32);

said one of said plates (47) is in said low-pressure chamber (44); and a compression spring (46) for assisting fuel pressure in closing said nozzle (10,11) with said needle (19) is between said one of said plates. (47) and a shoulder (45) of said low-pressure chamber (44).

11. A device as claimed in claim 10, wherein said portion (31) of said rod (8) is guided with a high degree of precision inside said seat of the sleeve (30), and comprises an annular groove (38) to reduce transverse components of fuel pressure in said sleeve (30).

12. A system as claimed in claim 8, wherein at least one of (a) said one of said plates (47) and said rod (8) and (b) said one of said plates (47) and said needle (19) are mutually engaged by at least one pair of mating surfaces (54, 56; 57, 58) respectively thereof.

* * * * *